United States Patent [19]

Urso

[11] Patent Number: 4,603,021

[45] Date of Patent: Jul. 29, 1986

[54] BUBBLE HUMIDIFIER

[76] Inventor: Charles L. Urso, 215 Newton St., Waltham, Mass. 02154

[21] Appl. No.: 732,454

[22] Filed: May 9, 1985

[51] Int. Cl.[4] ..... B01F 3/04

[52] U.S. Cl. ..... 261/30; 261/91; 55/232; 55/247

[58] Field of Search ..... 261/91, 30; 55/247, 55/232

[56] References Cited

U.S. PATENT DOCUMENTS

| | | | |
|---|---|---|---|
| 1,345,131 | 6/1920 | Cleworth | 55/232 |
| 1,409,593 | 3/1922 | Schram | 55/232 |
| 1,493,525 | 5/1924 | Freedenburg | 261/91 |
| 1,616,545 | 2/1927 | Perkins | 261/91 |
| 1,761,136 | 6/1930 | Lord | 261/91 |
| 1,894,864 | 1/1933 | Hall | 261/91 |
| 2,078,202 | 4/1937 | Manning | 261/91 |
| 2,174,147 | 9/1939 | Unger, Jr. | 261/91 |
| 2,710,665 | 6/1955 | Stratton | 55/232 |
| 2,733,056 | 1/1956 | Marky | 261/87 |
| 2,755,129 | 7/1956 | Lyon | 261/91 |
| 3,149,935 | 9/1964 | Jamison et al. | 261/91 |
| 3,273,865 | 9/1966 | White | 261/91 |
| 3,285,586 | 11/1966 | Powers | 55/232 |
| 3,348,822 | 10/1967 | Vieceli et al. | 261/91 |
| 3,471,133 | 10/1969 | Sherwood | 261/91 |

FOREIGN PATENT DOCUMENTS

| | | | |
|---|---|---|---|
| 221862 | 6/1959 | Australia | 261/91 |
| 1958273 | 6/1971 | Fed. Rep. of Germany | 261/91 |
| 2431429 | 1/1976 | Fed. Rep. of Germany | 261/91 |
| 480224 | 6/1916 | France | 261/91 |
| 385141 | 10/1973 | U.S.S.R. | 261/91 |

*Primary Examiner*—Tim Miles

[57] ABSTRACT

The invention comprises a reservoir for containing water, and a bubble tank which holds water for forming bubbles. A bubble generator, rotatably supported and positioned in contact with the tank water, mingles water and atmospheric air such that copious bubbles are formed when the generator is rotated. The water in the bubble tank is maintained at a substantially constant level by a feedback system which draws replacement water from the reservoir as the tank water is evaporated. A blower moves atmospheric air to the erupting bubbles to hasten evaporation and propels the moistened air into the local environment.

10 Claims, 5 Drawing Figures

BUBBLE HUMIDIFIER

TECHNICAL FIELD

This invention relates to portable humidifiers and specifically to portable humidifiers which evaporate water from surfaces resulting from production of bubbles.

BACKGROUND OF THE INVENTION

Typical portable humidifiers employ an absorbent pad that is fashioned into a belt that rides on a drum or a pair of rollers. The pad is wetted by cycling it through a water reservoir. A fan forces room air through the pad, thereby evaporating moisture for distribution into the room. Other humidifiers have a stationary pad and a pump for spreading water onto the pad. A variety of less common types of humidifiers also exist and most, as do the porous pad type, function well when they are clean.

Keeping them clean, however, is a major problem with humidifiers. Nearly all types need to be cleaned frequently (every week or two for some types) and the process is often burdensome and tedious. Minerals, previously dissolved in the water, can clog working parts, and by-products from microbes can cause offensive odors. In humidifiers with porous pads, residue and microbial activity can build up in the pores to reduce efficiency and increase offensive odors. The pads must be disengaged and the residue removed, which is generally not an easy task. Eventual replacement of the pads is also necessary. Most submerged components must also be cleaned often. Chemical additives to the reservoir water may help, but are not a panacea.

An advantage of this invention is that it obviates the need for evaporation pads and the like, thereby eliminating an important source of offensive odors.

Another advantage of this invention is that it provides a humidifier with high functional performance while substantially reducing typical humidifier maintenance time. It includes a bubble generator which produces myriad erupting bubbles presenting myriad water surfaces for evaporation. Periodic replacement of a removable portion of the bubble generator is much simpler than the effort generally required for removal and replacement of evaporation pads. Further, there is little cleaning required since there is minimal submerged material.

Another advantage is that the replaceable portion of the bubble generator is small enough to fit in the palm of a hand. Therefore, it takes up many times less storage or shelf space at a wholesale or retail store than evaporation pads do.

Since the replaceable portion of the bubble generator can be be produced from a relatively small amount of molded plastic and standard wire cloth, replacement cost is very competitive with the cost of evaporation pads and the like.

Another advantage of this invention is that it can be produced at low cost.

SUMMARY OF THE INVENTION

The invention comprises a reservoir for containing water and a bubble tank which holds water for forming bubbles. A bubble generator rotatably supported and positioned in contact with the tank water, mingles water and atmospheric air such that copious bubbles are formed when the generator is rotated by a motor. The water in the bubble tank is maintained at a substantially constant level by a feedback system which draws replacement water from the reservoir as the tank water is evaporated. A blower moves atmospheric air to the erupting bubbles to hasten evaporation and propels the moistened air into the local environment.

BRIEF DESCRIPTION OF THE DRAWINGS

The accompanying drawings in combination with the description herewith, illustrate features and advantages of the invention. Like reference characters in different views refer to the same parts. The drawings are intended to illustrate principles of the invention and are not necessarily to scale and in which drawings.

DETAILED DESCRIPTION OF THE INVENTION

Figure 1:
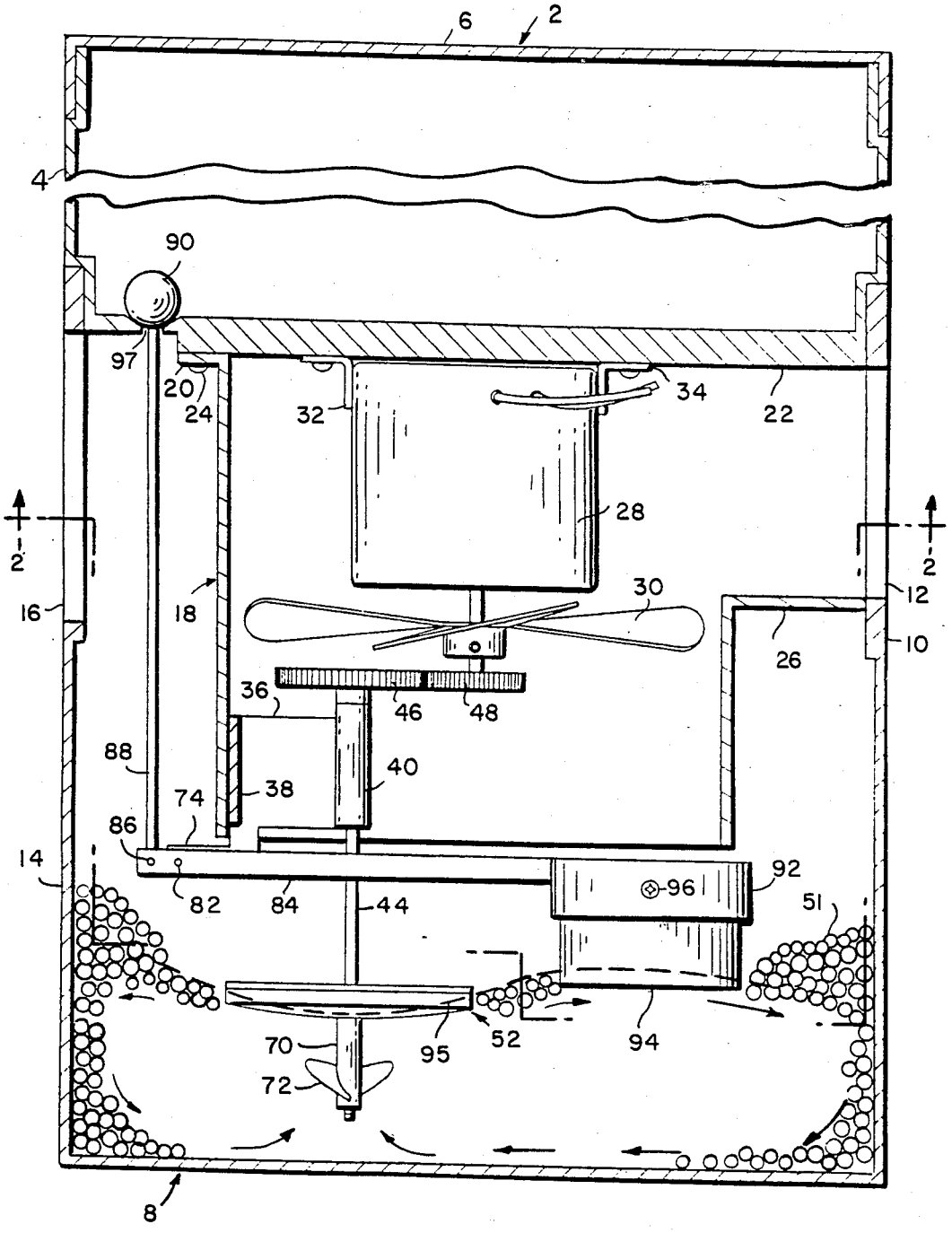
FIG. 1 is a sectional view taken along the vertical centerline of the invention.
Figure 2:
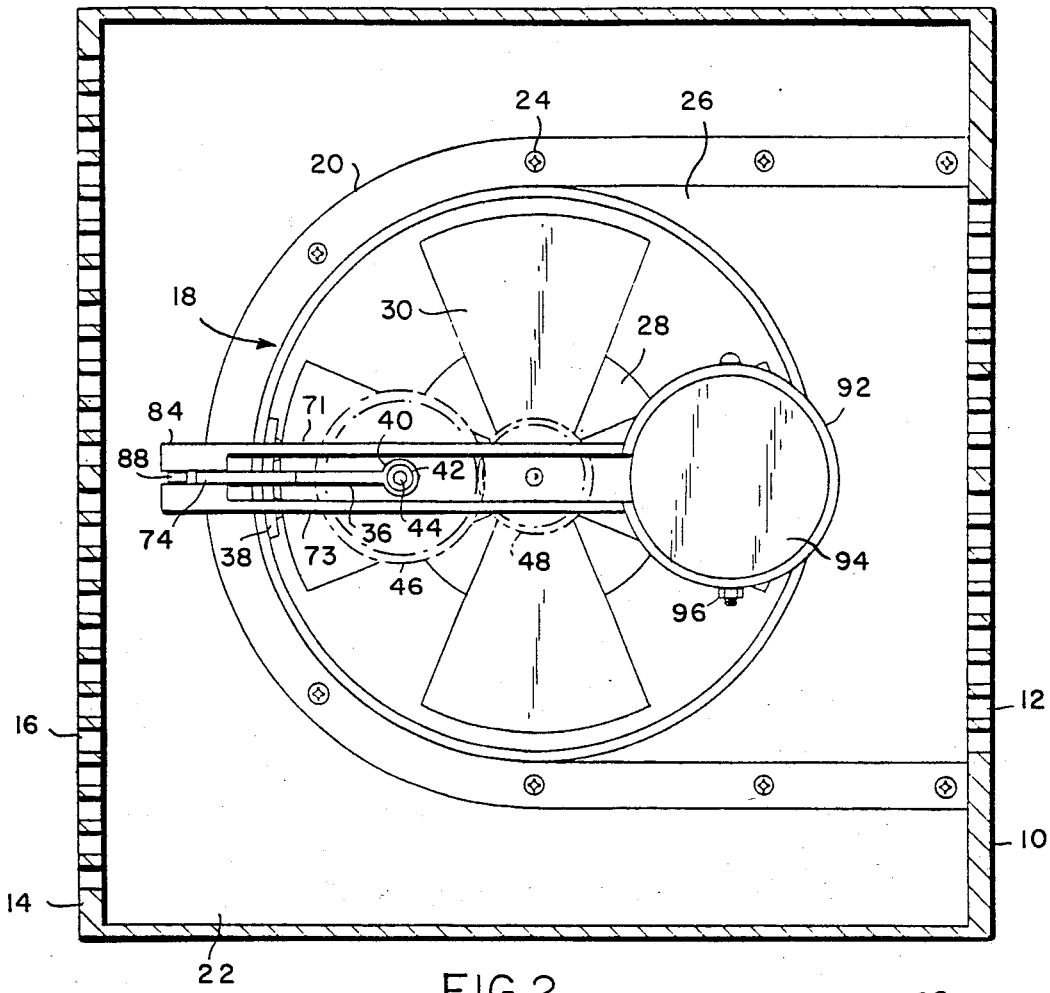
FIG. 2 is a horizontal sectional view taken along the line 2—2 of FIG. 1, wherein only the bubble tank is sectioned and the bubble generator and water propeller are removed.

A bubble humidifier is referred to generally by the numeral 2 in FIG.1. The invention comprises a six-sided reservoir 4 including a top side which is removable cover 6. A lower portion of reservoir 4 is shaped to be detachably fitted into an upper portion of a bubble tank 8. A vertical wall 10 of tank 8 includes an inlet vent 12 (FIGS. 1 and 2) comprising a plurality of vertical slots through a portion of the wall. An opposite wall 14 of tank 8 includes an outlet vent 16 comprising a plurality of vertical slots through a portion of that wall. Within tank 8 is a blower duct 18 (FIGS. 1 and 2) having a flange 20 extending from its upper end. The duct flange 20 is screwed to a bottom side 22 of reservoir 4 with screws 24. An upper portion of duct 18 is formed into a vestibule 26 which extends perpendicularly from the main body of the duct. An outer end of the vestibule 26 abuts against the periphery of inlet vent 12 and surrounds the same, thereby establishing a free air route through the inlet vent into duct 18.

Figure 3:
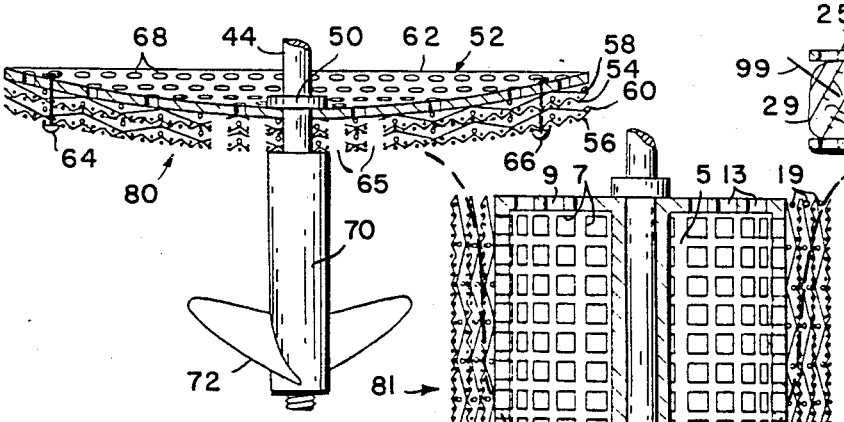
FIG. 3 is a sectional view taken along the vertical axis of a preferred embodiment of the bubble generator.

Within duct 18 is an electric motor 28 having a fan 30 fixed to its drive shaft. Motor 28 is screwed to the bottom side 22 of reservoir 4 by means of L-shaped brackets 32,34 (FIG. 1) fixed to the housing of the motor. A support bracket 36 is fixed to a lower inner surface of duct 18 by riveting a curved flange 38 (FIG.2), extending from an edge of the bracket, to the duct. Fixed to an opposite edge of bracket 36 is a bearing sleeve 40 which houses a bearing 42. Rotatably supported by bearing 42 is a shaft 44 (best seen in FIG. 1). An upper end portion of shaft 44 is fixedly keyed to a driven gear 46. In mesh engagement with gear 46 is a drive gear 48 which is fixedly attached to the drive shaft of motor 28. Fixedly encircling a lower portion of shaft 44 is a stop flange 50 (FIG. 3). Abutted against stop flange 50 and coaxially mounted on shaft 44 is a preferred embodiment of a bubble generator 52.

Bubble generator 52 comprises an annular meshwork body 80 having a plurality of spaced plies of meshed strands or wire cloth 54,56. Sizes are 30 mesh of wire diameter 0.012 inch (other mesh and gauge sizes might also function properly). Each ply has one face symmetrically convex and an opposite face symmetrically concave. The plies are fixedly coaxially positioned adjacent each other and the convex faces of all the plies face in the same axial direction. The spacing between the plies is provided by inserting coarser wire cloth 58,60, having relatively greater opening width and wire diameter, therebetween. Spacing plies of 4 mesh having 0.080 inch wire diameter are satisfactory, but other mesh and gauge sizes might also be adequate. A plurality of holes 65 pierce through meshwork body 80 to enhance the infiltration of water and air into the meshwork. Meshwork body 80 is supported by an annular perforated dish 62 having a symmetrically convex surface on which the former is fixedly attached with fasteners 64,66. Perforations 68 allow the passage of air through dish 62 to access the meshwork. A central aperture through dish 62 and meshwork body 80 receives shaft 44. A lower end portion of shaft 44 is threaded to mate with an internally threaded sleeve 70 on which a water propeller 72 is fixedly attached. By tightening propeller sleeve 70 against meshwork body 80, bubble generator 52 is detachably fixed to shaft 44.

The bubble generating system operates in a water bath maintained at a substantially constant level. This is achieved by a feedback system which includes a lever 84 (FIGS. 1 and 2) pivotally supported on an L-shaped arm 74. The arm 74 is formed as an extension of a lower portion of bracket 36. Arm 74 extends exteriorly and radially out of an open lower end of duct 18 and is sandwiched between two symmetrical members 71,73 (FIG. 2) of lever 84. An end portion of arm 74 includes an aperture which receives a pin 82 (FIG. 1). The pin 82 passes through members 71,73 of lever 84 and is the pivot point of the lever. A second pin 86 passes through an end portion of lever 84 and through an end portion of a rod 88 to pivotally attach the same to the lever. Rod 88 passes through an aperture 97 in bottom side 22 of reservoir 4. An opposite end portion of rod 88 is fixedly attached to a resilient rubber ball 90 within reservoir 4. An opposite end portion of lever 84 is formed into a float holder 92 which fixedly holds a rigid plateic foam float with the aid of a fastener 96. The combination is positioned such that when the water level in tank 8 is above bubble generator 52, float 94 and lever 84 draw ball 90 against aperture 97 by means of the rod linkage. Thus, aperture 97 is sealed. As the water level of tank 8 drops, the weight of float 94 and lever 84 push ball 90 upward by means of the lever and rod linkage. This allows water in reservoir 4 to drain through aperture 97 into tank 8. When the depleted water in tank 8 is replaced, float 94 rises and aperture 97 is resealed by ball 90.

It should be noted that tank 8 should have a noncircular horizontal cross-section, since a curcular shape would tend to promote excessive rotation of the tank water during operation.

Most of the components of this invention can be formed from molded plastic. The notable exceptions being the motor 28, shaft 44, and the various fasteners. Therefore, the invention can be produced at low cost.

OPERATION OF THE INVENTION

After lifting off cover 6, reservoir 4 may be filled with water. Water will also drain into tank 8 and be kept at a proper level by the described feedback system. With reservoir 4 filled, cover 6 may be replaced and electric power may be supplied to motor 28. When the motor is running, air will be drawn into inlet vent 12 to pass through duct 18 and out of its open lower end. Simultaneously, bubble generator 52 rotates to create a whirlpool funnel or vortex 95 in the tank water, wherein air has access to the bubble generator by way of the funnel. The air is sucked through perforations 68 to enter meshwork body 80. Centrifugal force compels air and water to move spirally outward through the maze within the meshwork where they mingle to form abounding bubbles 51. The bubbles are expelled spirally outward from the periphery of the bubble generator. Consequently, the displaced liquid and gas creates a partial vacuum which draws more air and water into the meshwork to continue the process. While the fan 30 helps to speed the flow of air into the topside of the meshwork body 80, the propeller 72 helps to speed the flow of water into the underside of the body, thereby increasing the efficiency of the process. The holes 65 enhance the infiltration of the gas and liquid into the meshwork.

The myriad erupting bubbles within tank 8 present myriad water surfaces of transient craters, crests, membranes, and other minute surface forms. These abounding water surfaces are struck by the fast moving air expelled from the open end of duct 18 to result in rapid evaporation. Air escaping from within the erupting bubbles is also laden with moisture which combines with the surface moistened air. The combined humidified air is expelled through outlet vent 16 into the local environment.

Highly effective rotational speeds for the bubble generator 52 are generally above 1200 rmp. However, it may be desirable to rotate bubble generator 52 at a relatively different speed than fan 30. The reasons may include preferences of motor power, sound control, or preferred air speeds relative to evaporation rates. Therefore, the tooth ratio of driven gear 46 to drive gear 48 may be selected accordingly.

MAINTENANCE OF THE INVENTION

Access to the interior of tank 8 is achieved by simply lifting off reservoir 4. All the components within tank 8 are attached to the bottom side 22 of reservoir 4. Therefore, wiping off the inner surfaces of the tank is achieved without interference from the components when reservoir 4 is removed.

If necessary, meshwork body 80 and its support dish 62 may be replaced after unscrewing propeller sleeve 70. The sleeve is then screwed back in place.

MODIFICATION OF THE INVENTION

A less expensive embodiment of the invention can be produced by directly connecting shaft 44 to the motor drive shaft. This eliminates the gears 46,48, the bearing 42, and the bearing sleeve 40. In either case, sound can be deadened by inexpensive conventional methods such as covering the exterior surfaces of the invention with rigid plastic foam or other insulating means.

Figure 4:
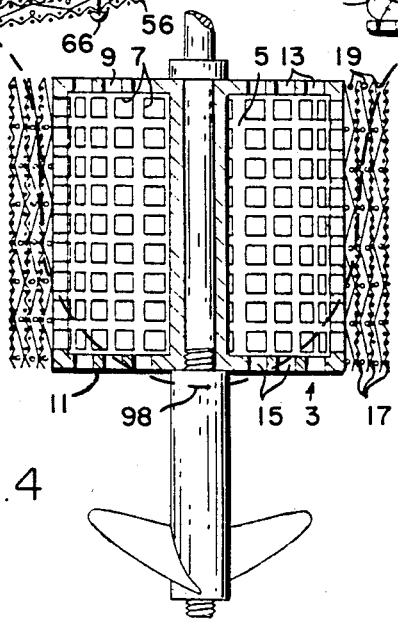
FIG. 4 is a sectional view taken along the vertical axis of an alternative embodiment of the bubble generator.

An alternative embodiment of a bubble generator is shown in FIG. 4. It comprises a hollow plastic drum-shaped core 3 including a continuous wall 5 encircling the core axis. Wall 5 is perforated with perforations 7. Also included are upper and lower end walls 9,11. Each is perforated with perforations 13,15, respectively. A meshwork body 81 encircling core 3 is fixedly attached to the same. Meshwork body 81 includes a plurality of spaced plies of meshed strands or wire cloth 17. Spacing is achieved with plies of coarse wire cloth 19. The plies of wire cloth 17 and coarse wire cloth 19 can be applied with a single strip of each, but combined and wound together in a succession of layers. The ends of the strips are fixed to the main body with staples, wire, or other suitable means. Mesh and gauge sizes of the wire cloth plies are similar to the preferred embodiment. The remaining components of the alternative bubble generator, illustrated in FIG. 4, are substantially the same as those of the preferred embodiment. An operatively related vortex profile 98 is indicated in the figure.

Figure 5:
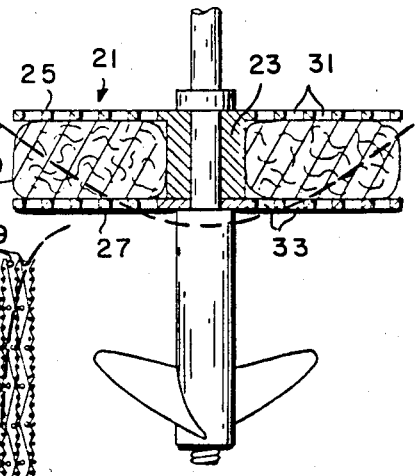
FIG. 5 is a sectional view taken along the vertical axis of another alternative embodiment of the bubble generator.

Still another alternative embodiment of a bubble generator is shown in FIG. 5. It comprises a molded plastic circular reel 21 including a core 23 and upper and lower flanges 25,27 fixedly attached to the core. The flanges 25,27 are perforated with perforations 31,33, respectively. A doughnut-shaped meshwork body 29 encircles core 23 and is supported between the flanges 25,27. Lower flange 27 is molded separately from the remainder of reel 21 so that the former may be attached after mounting meshwork body 29 about core 23. Meshwork body 29 comprises loosely woven or loosely packed plastic or metal strands. The remaining components of the alternative bubble generator, illustrated in FIG. 5, are substantially the same as those of the preferred embodiment. An operatively related vortex profile 99 is indicated in the figure.

Features of the three embodiments shown may be combined or modified to form other embodiments. For example, dish 62 and meshwork 80 may be deepened to form a bowl-shaped generator. Or, drum-shaped core 3 and its meshwork 81 may have a form likened to the frustum of a cone preferably positioned with the frustum base on top.

In relatively small constructions of the bubble humidifier 2, the reservoir 4 may be fashioned from translucent plastic to determine the water level without lifting the cover 6.

In larger constructions of the invention, common conventional accessories associated with humidifiers may be added. Such accessories may include a water level gauge, an adjustable humidistat, casters, adjustable louvers at the outlet vent 16, a low-water shutoff, a refill light, and others.

It is understood that various other modifications may be made without departing from the spirit of the invention as claimed.

I claim

1. a bubble humidifier comprising:

a bubble tank for holding water for forming bubbles;

a bubble generator comprising a meshwork body having small interstices for bubble generation rotatably supported and positioned in contact with the tank water so as to form a vortex in the water during operation such that when the body is driven to rotate, centrifugal force compels atmospheric air and the water through the meshwork to mingle and form copious bubbles which are expelled from the body;

means for rotating the bubble generator; and blower means for moving atmospheric air to the erupting bubbles to hasten the evaporation of the water and for propelling the resulting moistened air into the local environment.

2. The bubble humidifier of claim 1, wherein a water propeller is positioned beneath the meshwork body and fixedly coaxially connected to the same such that rotation of the combination propels water to flow upwardly into the meshwork body.

3. The bubble humidifier of claim 1, wherein the meshwork body includes a plurality of holes therein positioned to enhance the infiltration of water and air into the meshwork.

4. The bubble humidifier of claim 1, wherein the meshwork body is shaped to have a convex side and an opposite side such that when the body is rotating in water, water access to the body is primarily by way of the convex side and air access to the body is primarily by way of the opposite side.

5. The bubble humidifier of claim 4, wherein the meshwork body comprises a plurality of spaced plies of meshed strands, each ply having one face convex and an opposite face concave, wherein the plies are fixedly coaxially positioned adjacent each other and the convex faces of all the plies facing in the same direction.

6. The bubble humidifier of claim 5, wherein the meshwork body is supported by a perforated dish rotatably mounted, wherein the dish includes a surface on which the meshwork body is fixedly coaxially attached.

7. The bubble humidifier of claim 1, wherein the meshwork body is supported by a hollow drum-shaped core rotatably mounted and the core perforated through all exterior surfaces to allow the passage of air and water into and out of the core, wherein the meshwork body surrounds the core and is fixed to the same.

8. The bubble humidifier of claim 7, wherein the meshwork body comprises a plurality of spaced plies of meshed strands wrapped about the core.

9. The bubble humidifier of claim 1, wherein the meshwork body is mounted on a rotatably supported reel having two opposing perforated flanges, each flange attached to respective opposite ends of a core wherein the body encircles the core and is held between the flanges.

10. A bubble humidifier comprising:

a bubble tank for holding water for forming bubbles;

a bubble generator rotatably supported and positioned in contact with the tank water for mingling water and atmospheric air such that copious bubbles are formed when the generator is rotated;

means for rotating the bubble generator;

blower means for moving atmospheric air to the erupting bubbles to hasten the evaporation of the water and for propelling the resulting moistened air into the local environment;

a reservoir for holding a water supply separate from the bubble tank water, wherein the reservoir is detachably fixed to the bubble tank;

means for maintaining the bubble tank water at a substantially constant level by automatically replenishing the evaporating bubble tank water supply with water from the reservoir; and the bubble generator, the means for rotating the bubble generator, the blower means, and the means for maintaining the bubble tank water at a substantially constant level, are all attached to the reservoir such that they form a unit which is detachable from the bubble tank.

* * * * *